US006712938B1

(12) United States Patent
Leppäkoski et al.

(10) Patent No.: US 6,712,938 B1
(45) Date of Patent: Mar. 30, 2004

(54) METHOD FOR CALENDERING

(75) Inventors: Helena Leppäkoski, Lempäälä (FI); Pekka Koivukunnas, Järvenpää (FI); Kari Hasanen, Kerava (FI); Timo Torvi, Helsinki (FI); Petteri Venetjoki, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/110,571

(22) PCT Filed: Oct. 12, 2000

(86) PCT No.: PCT/FI00/00886

§ 371 (c)(1),
(2), (4) Date: Apr. 12, 2002

(87) PCT Pub. No.: WO01/27390

PCT Pub. Date: Apr. 19, 2001

(30) Foreign Application Priority Data

Oct. 13, 1999 (FI) ..... 19992215

(51) Int. Cl.[7] ..... D21G 1/00; D21G 9/00

(52) U.S. Cl. ..... 162/198; 162/204; 162/206; 100/38; 700/128

(58) Field of Search ..... 162/204–207, 162/198, 263; 100/38, 41, 42; 700/127–129

(56) References Cited

U.S. PATENT DOCUMENTS

| | | | | | |
|---|---|---|---|---|---|
| 3,974,248 | A | * | 8/1976 | Atkinson | 264/408 |
| 4,370,923 | A | | 2/1983 | Schmidt | 100/47 |
| 4,734,229 | A | * | 3/1988 | Johnson et al. | 264/40.6 |
| 4,986,177 | A | * | 1/1991 | Masek et al. | 100/163 R |
| 5,649,448 | A | * | 7/1997 | Koskimies et al. | 73/159 |
| 5,932,039 | A | * | 8/1999 | Popp et al. | 156/64 |
| 6,024,838 | A | | 2/2000 | Van Haag et al. | 162/361 |
| 6,264,795 | B1 | * | 7/2001 | Hamel | 162/207 |
| 6,542,582 | B1 | * | 4/2003 | Smith, Jr. | 379/52 |
| 2002/0038197 | A1 | * | 3/2002 | Chen et al. | 702/182 |
| 2003/0116296 | A1 | * | 6/2003 | Lin et al. | 162/205 |

FOREIGN PATENT DOCUMENTS

| | | | |
|---|---|---|---|
| DE | 37 41 680 A1 | 6/1989 | D21G/1/00 |
| DE | 44 29 455 A1 | 2/1996 | |
| DE | 196 13 878 C1 | 6/1997 | D21G/1/00 |

* cited by examiner

*Primary Examiner*—José A. Fortuna
(74) *Attorney, Agent, or Firm*—Cohen, Pontani, Lieberman & Pavane

(57) ABSTRACT

The present invention relates to a method for calendering a moving web (1) of paper or board. The web (1) is passed to a calender (2) and calendered therein. At least one quality of the calendered web (1) is measured at a first measurement point (3) adapted at a location downstream from the calender (2). Additionally, at least one quality of the web (1) entering the calender (2) is measured at a second measurement point (4) adapted at a location between the calender (2) and the preceding section of the line. A control variable (6) affecting the calendering effect on the calender (2) is controlled by a feedback control scheme based on the measurement result obtained from said first measurement point (3) and a control variable (9) affecting the processability of the web (1) to be calendered is controlled by a feedback control scheme based on the measurement result obtained from said second measurement point (4).

16 Claims, 1 Drawing Sheet

METHOD FOR CALENDERING

PRIORITY CLAIM

This is a national stage of PCT application No. PCT/FI00/00886, filed on Oct. 12, 2000. Priority is claimed on that application, and on patent application No. 19992215 filed in Finland on Oct. 13, 1999.

FIELD OF THE INVENTION

The present invention relates to a method for calendaring a moving web of paper or board.

BACKGROUND OF THE INVENTION

In calendering, a moving web of paper or board is treated in a nip formed between revolving rolls. The amount of treatment occurring in the web being calendered is affected by the calendering conditions and the qualities of the web being treated. Variables related to the calendering effect are those suited for the control of the calendering process, such as the temperature and speed of rotation of the rolls, as well as the linear load imposed on the web in a nip between two rolls. In regard to the qualities of the web being treated, such as the web moisture content, temperature, basis weight and density are those affecting the amount of web treatment taking place. For instance, moist and warm paper is treated more effectively than dry and cold paper under the same calendering conditions. Respectively, it is possible to cause a larger density change in a paper approaching with a low density the calender under the same calendering conditions than what is possible in a paper already having a high density.

The properties of a moving web of paper or board entering a calender are reflected, not only in the processability of the web, but also in the calendering process conditions. An example of such a mutual interaction is heat transfer between the web and the calender rolls. The amount and direction of heat transfer are affected by the temperature and moisture of the web being calendered. Herein, it is even possible that an uneven temperature and/or moisture profile of the web entering the calender may gradually change the temperature profile of the rolls. The resulting thermal expansion of the rolls in turn changes the peripheral profile of the rolls, whereby also the loading profile of the nip changes.

In control theory, control strategies can be categorized in two different major classes known either as feedback control or feedforward control depending on how the control signal is applied. In feedback control, the measured value of the process variable to be controlled is compared with a set value and, whenever necessary, the value of a control variable in the control circuit is changed so as to bring the difference between the set value and the measured value to a minimum. In feedforward control, the value of the control variable is changed on the basis of some other input signal value than that of the actual process variable being controlled. Generally, the input signal in feedforward control is some measurable disturbance of the process whose magnitude cannot be directly affected by the control circuit, but whose effect on the actual process variable being controlled can be compensated for by way of proper tuning of the control circuit.

Generally, an effective control system can be configured by combining feedback control with feedforward control. Herein, feedforward control is used in a predictive manner to compensate for the effect of known process disturbances by way of utilizing a priori information on the interdependence between the disturbance and the process variable being controlled and, on the other hand, between the control action and the process variable being controlled. At the same time, feedback control is used to assure that the process variable being controlled stays close to its set value. The latter control circuit is mandatory, because not all disturbance effects are measurable and, moreover, feedforward control is inherently slightly inaccurate.

In a multivariate control system based on the use of two or more control variables, the benefits of feedforward control are accentuated. By utilizing information obtained on the state of disturbance parameters, the chances are improved to select those control variables that offer optimal disturbance compensation. Simply, if the cause of a disturbance is included in the model of the control algorithm, the better are its possibilities of reaching an optimal correction to the situation.

As mentioned above, it is known in the art that the changes in the qualities of a web passing a calender are effected, not only by the calendering conditions, but also by the properties of the web entering the calender. However, it is customary to measure in a paper- or board-making process the qualities of the moving web only after each section, for instance, at the upwinder of a paper-making machine or of an off-line calender. Since the qualities of the web being calendered are not conventionally measured before the calender, variations in these qualities represent unknown disturbances to the calender control systems and their effect can be identified only from web quality measurements performed downstream from the calender. Hence, control strategies applicable to a calender must be implemented using feed back control alone, with the penalty that such a control scheme can react only after the effect of disturbances becomes explicit on the measurement value of the process variable being controlled.

The fact that the qualities of the web being calendered are not conventionally measured upstream in front of the calender also complicates the identification of causes behind problems possibly occurring in the web profile. The contribution of the calender itself in a web profile problem can be identified by way of temporarily eliminating the effect of the calender from the process measurements. In conventional measurement arrangements, this can be accomplished only by performing measurements at an upwinder on such an incoming web that has passed the calender with the calender nips set open. However, this is an unusual test which is launched only after the problem has been ongoing for quite a time so that production losses have already occurred due to the problem.

In reality, a web profile problem rarely is so simple that its origin can be traced to the calender alone or, respectively, in front of the calender alone. Namely, it is also possible that an uneven profile of the web entering the calender may gradually change the temperature profiles, the peripheral roll profiles and the loading profiles of the calender, whereby a simple web profile problem originating upstream from the calender may change the calendering conditions into such a direction that the calender itself begins to cause profile problems.

SUMMARY OF THE INVENTION

It is an object of the present invention to provide an entirely novel type of calendering method capable of overcoming the problems hampering the above-described prior-art techniques.

The goal of the invention is achieved by virtue of measuring the qualities of the web to be calendered also upstream from the calender, whereby the measurement results can be utilized in feedback control by way of directly modifying the factors that affect web processability. Such qualities subject to measurement may be, e.g., the moisture content, temperature, basis weight and density of the web. Then, deviations in such quality variables measured upstream from the calender can be considered as a category of disturbances known to the control system. Resultingly, the common feedback control can be complemented with feedforward control scheme capable of handling these detectable disturbances. Inasmuch the control algorithm of a feedforward control system attempts to compensate for the effect of a detected disturbance in a process variable being controlled by way of adjusting a proper control variable, it is possible that in an optimally designed system the effect of the disturbance on the process variable being controlled may become completely eliminated.

Furthermore, the measurement results of web qualities recorded prior to the passage of the web through the calender may also be utilized in feedback control by way of adjusting the modifiable properties of the web to be calendered, such as its moisture content and temperature. In the case that the line includes auxiliary equipment for prewetting and/or preheating the web prior to its entry into the calender, the calender control algorithm can be enhanced through pretreating the web so that those properties of the web to be calendered that affect its processability are modified more compatible with the calendering process.

The invention offers significant benefits.

In both of the above-described embodiments, the calender control algorithm can be improved substantially in regard to a situation, wherein the state of the web being calendered is measured only downstream after the calender. Due to the improved control scheme, the runnability of the calender is improved and the broke produced on the calender is reduced. Measurement results obtained upstream from the calender may also be utilized in the fault diagnostics of the calender. On the basis of the measurement results, it is easy to make a quick diagnosis as to the origin of a given disturbance, whether caused by the calender or other subprocesses of the papermaking machine, whereupon the situation can be corrected toward a better calendering result in a manner superior to the prior art. Obviously, the measurement of qualities of the web to be calendered both upstream from the calender and downstream therefrom also makes fault identification easier in web profile problems.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in more detail by making reference to the appended drawings in which.

DETAILED DESCRIPTION OF THE PRESENTLY PREFERRED EMBODIMENTS

Figure 1:
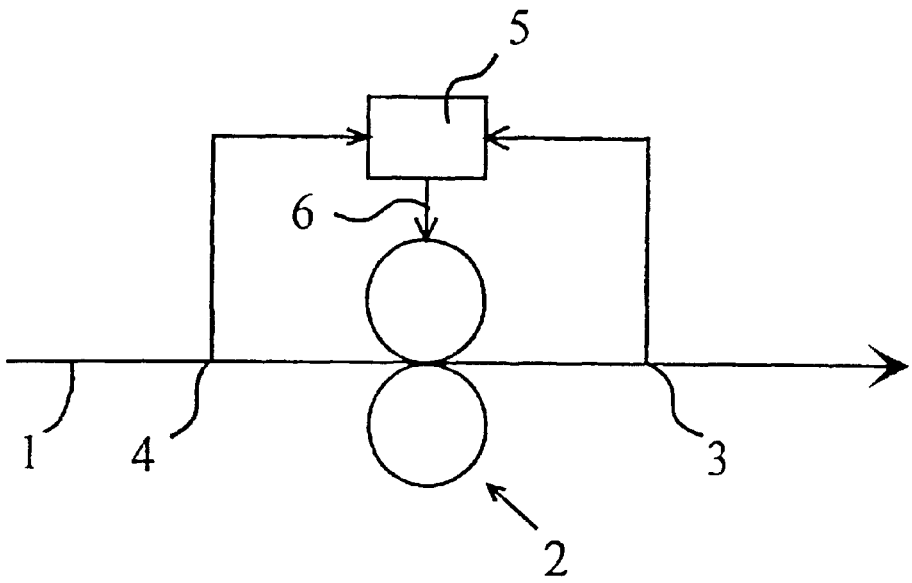
FIG. 1 shows diagrammatically an embodiment according to the invention.

Thus while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

Referring to the drawings, a web 1 to be calendered is passed through a calender 2 in a direction denoted by the arrow. At least one quality of the calendered web 1 is measured in a conventional manner at a first measurement point 3 located downstream after the calender 2. The qualities measured from the calendered web 1 at the first point 3 may be, e.g., web thickness, density, tension, basic weight and surface properties, such as gloss and smoothness. At an intermediate point between the calender 2 and a preceding section operating upstream from the calender 2, there is adapted a second measurement point 4, where measurements are also carried out for at least one quality of the web 1 entering the calender 2.

As shown in FIG. 1, at the second measurement point 4 is measured at least one processability-affecting quality of the web 1 entering the calender, such as the web temperature, moisture content or coat weight. A controller 5 compares the feedback signal, which is the measurement value from the first measurement point 3, with the set value and, when necessary, corrects the value of a control variable 6 to be issued to the calendering process 2 so as to minimize the difference between the value obtained from the first measurement point 3 and the set value. The control variables 6 may be selected from the group of main control variables that affect the calendering effect, such as linear loadings of nips and the temperatures of thermorolls. Additionally, the controller 5 receives feedforward information as the signal value obtained at the second measurement point 4, whereby the feedforward signal allows the controller 5 to compensate through the control variables 6 for the effects of disturbances in the processability of the web 1 entering the calender 2 on the calendering process. Generally, the feedforward signal is obtained from a measurable process deviation whose magnitude cannot be affected by the control circuit of the controller 5, but whose effect on the process variable to be controlled can be compensated for by a proper control scheme of the control circuit.

Accordingly, the function of the feedforward control is to predictively compensate for the effect of known process disturbances by way of utilizing a priori information on the interdependencies between the disturbance and the process variable being controlled and, on the other hand, between the control action and the process variable being controlled. At the same time, feedback control is used to assure that the process variable being controlled stays close to its set value. In fact, feedback control is mandatory, because all disturbance effects can never be measured exhaustively and, moreover, feedforward control is inherently slightly inaccurate.

Figure 2:
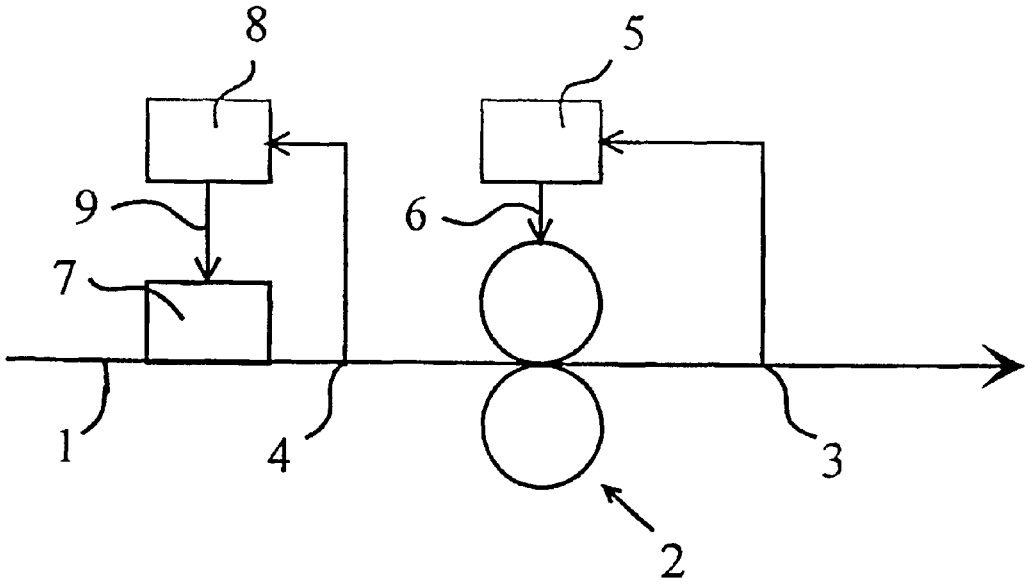
FIG. 2 shows diagrammatically another embodiment according to the invention.

In the embodiment shown in FIG. 2, there is located operative in conjunction with the calender 2 an auxiliary device 7 such as a wetting unit, heater and/or coater that can be used for modifying the processability-affecting qualities of the web 1 to be calendered. Measurement values, which are obtained at the second measurement point 4 located downstream after the auxiliary device 7 along the travel direction of the web 1, are taken as a feedback signal to a controller 8 of the auxiliary device 7 that makes necessary corrections in the value of a control variable 9 of the auxiliary device 7. This arrangement aims to keep the qualities of the web 1 entering the calender 2 in the best possible manner at optimal values for the calendering process 2.

In addition to those described above, the invention may have alternative embodiments.

The facilities of the second measurement point 4 sensing the qualities of the web 1 upstream in front of the calender 2 may also be utilized in the fault diagnostics of the calender 2. E.g., the values of the density, thickness, basis weight and tension profile of the web 1 at a point preceding the calender 2 are parameters that cannot be affected by the calender 2, but these measurement values of the web qualities offer a fast method to solve, e.g., the reasons why a certain control variable of the calender 2 may drift off limits. While the situation may be incorrectable by adjusting the calender 2, there may still be a chance of improving the calendering conditions through making changes in other variables of the paper- or boardmaking machine.

The embodiment according to the invention can also be employed in the state analysis of the calender 2. Since conventional calenders do not permit an accurate measurement of the linear loading profile of calender nips or the temperature profile of a thermoroll, these factors affecting the processability of the web to be calendered are known only by the values of their control variables, not by their actual physical states. Herein, the identification of profile defects in a calendered web can benefit from the information obtained on changes in the temperature, thickness, density and tension profiles of the web at the calender inasmuch these profiles may be measured in an embodiment of the invention both upstream and downstream in regard to the calender. Of these, web thickness, density and tension often represent mutually alternative material parameter values, because their profile shapes have been found to correlate strongly with each other. From such a comparison, it is possible to infer whether the disturbing change in a profile of the web occurs in the calender or upstream therefrom.

What is claimed is:

1. A method for calendering a moving web of paper or board comprising:

passing the web to a calender;

calendaring the web in the calender;

measuring at least one quality of the calendered web at a first measurement point downstream of the calender;

controlling a control variable affecting the calendaring effect imparted to the web by the calender using a feedback control scheme based upon the at least one quality of the web measured at the first measurement point;

measuring a temperature of the web entering the calender at a second measurement point upstream of the calender and downstream of a preceding section of a paper making machine comprising the calender; and controlling the temperature of the web prior to entering the calender by adjusting the temperature of the web by a feedback control scheme based upon the temperature measured at the second measurement point.

2. The method of claim 1, wherein the control variable affecting the calendaring effect imparted to the web by the calender comprises linear nip loading in the calender.

3. The method of claim 2, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

4. The method of claim 2, wherein the control variable affecting the calendaring effect imparted to the web by the calender comprises a temperature of thermorolls of a nip in the calender.

5. The method of claim 4, further comprising:

measuring a moisture content of the web entering the calender at the second measurement point; and controlling the moisture content of the web prior to entering the calender by adjusting the moisture content of the web by a feedback control scheme based upon the moisture content measured at the second measurement point.

6. The method of claim 5, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

7. The method of claim 4, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

8. The method of claim 2, further comprising:

measuring a moisture content of the web entering the calender at the second measurement point; and controlling the moisture content of the web prior to entering the calender by adjusting the moisture content of the web by a feedback control scheme based upon the moisture content measured at the second measurement point.

9. The method of claim 8, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

10. The method of claim 1, wherein the control variable affecting the calendaring effect imparted to the web by the calender comprises a temperature of thermorolls of a nip in the calender.

11. The method of claim 10, further comprising:

measuring a moisture content of the web entering the calender at the second measurement point; and controlling the moisture content of the web prior to entering the calender by adjusting the moisture content of the web by a feedback control scheme based upon the moisture content measured at the second measurement point.

12. The method of claim 11, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

13. The method of claim 10, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

14. The method of claim 1, further comprising:

measuring a moisture content of the web entering the calender at the second measurement point; and controlling the moisture content of the web prior to entering the calender by adjusting the moisture content of the web by a feedback control scheme based upon the moisture content measured at the second measurement point.

15. The method of claim 14, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

16. The method of claim 1, further comprising:

measuring a coat weight of the web entering the calender at the second measurement point; and controlling the coat weight of the web prior to entering the calender by adjusting the coat weight of the web by a feedback control scheme based upon the coat weight measured at the second measurement point.

* * * * *